United States Patent [19]

May

[11] Patent Number: 4,706,060

[45] Date of Patent: Nov. 10, 1987

[54] SURFACE MOUNT VARISTOR

[75] Inventor: John E. May, Skaneteles, N.Y.

[73] Assignee: General Electric Company, N.Y.

[21] Appl. No.: 911,929

[22] Filed: Sep. 26, 1986

[51] Int. Cl.[4] ..... H01C 7/10

[52] U.S. Cl. ..... 338/20; 338/271; 338/332

[58] Field of Search ..... 338/20, 271, 272, 332; 174/50.5, 50.51

[56] References Cited

U.S. PATENT DOCUMENTS 3,764,951 10/1973 Tachibana et al. ..... 338/20

4,551,269 11/1985 Hennings et al. ..... 338/20 X

*Primary Examiner*—E. A. Goldberg

*Assistant Examiner*—M. M. Lateef

*Attorney, Agent, or Firm*—Stanley C. Corwin; Birgit E. Morris

[57] ABSTRACT

A varistor having opposed first and second major surfaces. A first electrode is disposed on at least a portion of both the first and second major surfaces, and a second electrode is disposed on at least a portion of both the first and second major surfaces. The first and second electrodes are symmetrically disposed on the varistor body about an axis lying midway between and parallel to the first and second major surfaces.

11 Claims, 7 Drawing Figure

SURFACE MOUNT VARISTOR

BACKGROUND OF THE INVENTION

I. Field of the Invention

The present invention relates in general to varistors, and more particularly to such varistors having a symmetrical structure for surface mount applications.

II. Description of Related Art

Varistors, and especially metal oxide varistors, have gained widespread acceptance as devices for providing a nonlinear resistance function. The electrical characteristics of such voltage-dependent resistors are expressed in part by the relation:

$$I=(V/C)^n$$

where V is the voltage across the varistor, I is the current flowing through the varistor, C is a constant corresponding to the voltage at a given current, and the exponent n has a numerical value greater than 1. The value of n is calculated according to the following relation:

$$n = \frac{\log_{10}(I_2/I_1)}{\log_{10}(V_2/V_1)}$$

where $V_1$ and $V_2$ are the voltages at currents $I_1$ and $I_2$, respectively. The desired value for C depends upon the type of application in which the varistor is to be used. It is ordinarily desirable that the value of n be as large as possible, since this exponent determines the degree to which the varistor departs from Ohmic characteristics.

Although substantial effort on the part of many investigators has led to increasing understanding of the characteristics and methods of operation of metal oxide varistors, the device is nevertheless not completely understood. For this reason, many significant improvements in varistor operation are made more or less heuristically, and the reasons for the improvement or mechanism or the accomplishment thereof are not always known with complete certainty.

It is known, however, that the electrical properties of a varistor are determined primarily by the physical dimensions of the varistor body. The energy rating of a varistor is determined by the volume of the varistor body, the voltage rating of a varistor is determined by the thickness or current path length through the varistor body, and the current capability of the varistor is determined by the area of the varistor body measured normal to the direction of current flow.

The term "surface mount varistor" is generally used to describe a varistor in which both the input and output terminals are positioned on the same major surface of the varistor body. Surface mount varistors are particularly adapted for applications in which the varistor is to be placed upon, for example, a printed circuit board. In such applications, the conductive surfaces of the input and output terminals are typically positioned directly above the conductive runners of the printed circuit board. Solder paste is positioned between the conductive surfaces of the input and output terminals and the respective conductive runners of the printed circuit board. The entire assembly is then heated, causing the solder to melt and producing an electrical contact between the varistor terminals and the printed circuit board.

In such applications, it is essential that the varistor be properly oriented with respect to the printed circuit board prior to soldering. If the surface mount varistor is improperly oriented; i.e., if the major surface of the varistor on which the input and output terminals are positioned faces away from the printed circuit board, electrical contact between the circuit board runners and both terminals of the varistor will not be made. As a result, the circuit of the assembled printed circuit board will not function as intended. The requirement of verifying the proper orientation of the surface mount varistor prior to assembly adds considerable time and expense to the assembly process.

It is an object, therefore, of the present invention to provide a varistor having a plurality of major surfaces, each of which provides both an input and output terminal thereon.

It is another object of the present invention to provide a surface mount varistor having input and output terminals symmetrically disposed on opposed major surfaces thereof.

It is a further object of the present invention to provide a surface mount varistor which is fully passivated.

SUMMARY OF THE INVENTION

In accordance with the present invention, these and other objectives are achieved by providing a varistor body having a first major surface and an opposed second major surface. A first electrode is disposed on at least a portion of the first major surface and at least a portion of the second major surface. A second electrode is similarly disposed on at least a portion of the first major surface and a portion of the second major surface. The first and second electrodes are symmetrically disposed on the varistor body about an axis lying midway between and parallel to the first and second major surfaces. In one embodiment of the present invention, symmetrically disposed dielectric layers are provided to provide full passivation of the varistor.

DESCRIPTION OF THE DRAWINGS

A detailed description of the invention will be made with reference to the accompanying drawings, wherein like numerals designate corresponding parts in the several figures.

DESCRIPTION OF THE PREFERRED EMBODIMENT

The following detailed description is of the best presently contemplated mode of carrying out the invention. This description is not to be taken in a limiting sense, but is made merely for the purpose of illustrating the general principles of the invention. The scope of the invention is defined by the appended claims.

Figure 1:
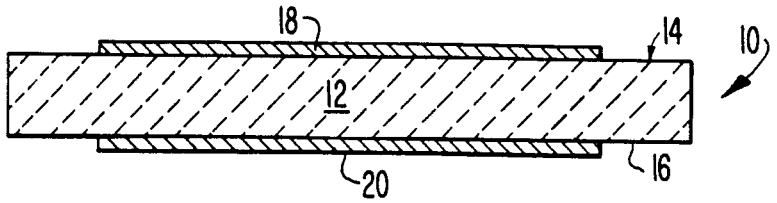
FIG. 1. PRIOR ART
FIG. 1 is a side-sectional view of a known varistor structure.

Referring to FIG. 1, there is shown a varistor 10 which includes a body portion 12 having a first major surface 14 and a an opposed second major surface 16. Body portion 12 is preferably a sintered body composed essentially of a metal oxide such as zinc oxide, and a plurality of preselected additives. Methods for manufacturing varistor body 12 are well-known to those skilled in the art and therefore will not be extensively described herein. Generally, by way of example and not of limitation, the formation of varistor body 12 includes the steps of mixing the major constituents, spray drying and pressing into a compact "green" pellet. The pellet is then sintered at a high temperature to provide a body having the desired varistor characteristics.

Varistor 10 further includes first and second electrodes 18 and 20, which are applied respectively to the first major surface 14 and second major surface 16 of the varistor body 12. Conveniently, and again by way of example rather than of limitation, electrodes 18 and 20 may be silver paint electrodes which are applied to the first major surface 14 and second major surface 16 of varistor body 12 by silkscreening or the like, and fired at a relatively high temperature such as 800° C. to provide electrical contact to the varistor body 12. Electrically conductive leads (not shown) may be attached to the electrodes 18 and 20, typically by soldering.

Figure 2:
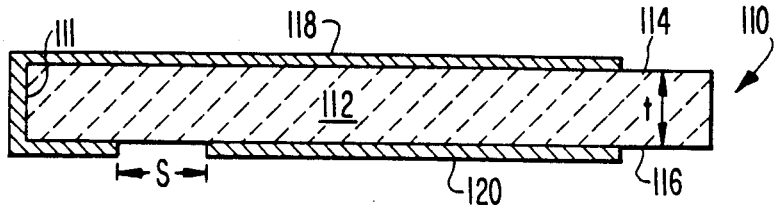
FIG. 2. PRIOR ART
FIG. 2 is a side-sectional view of a known varistor structure in which two electrodes are provided on the same major surface of the varistor body.

FIG. 2 illustrates a known varistor 110 useful in surface mount applications. In this and the following figures, like elements are designated by like reference numerals. A varistor body 112 has first and second electrodes 118 and 120 attached respectively to the first major surface 114 and second major surface 116 of the varistor body 112. The formation of the varistor body 112, as well as the attachment of the electrodes 118 and 120 thereto, may be accomplished as hereinabove described in conjunction with FIG. 1.

In the varistor 110 a portion of the first electrode 118 which is associated with the first major surface 114 is extended along a first end 111 of the varistor body 112 and further extended along a portion of the second major surface 116. Thus, both the second electrode 120 and at least a portion of the first electrode 118 are positioned on a single major surface 116 of the varistor body 112. The proximal distance S between the second electrode 120 and the portion of the first electrode 118 positioned on the second major surface 116 of the varistor body 112 is preferably greater than the thickness t of the varistor body 112 between the first and second major surfaces 114 and 116. (The term "proximal" as used herein means the closest point-to-point distance between electrodes.) This preferred spacing reduces arcing and surface leakage current between electrodes 118 and 120, and tends to cause current to flow through the thickness t of the varistor body 112 between electrodes 118 and 120, rather than along the surface 116 of the varistor.

The varistor 110 is particularly adapted for those applications in which the varistor is to be placed upon, for example, a printed circuit board. In such applications, the varistor is oriented so that the second major surface 116, on which a portion of both electrodes 118 and 120 are positioned, faces the printed circuit board. The conductive surfaces of the electrodes 118 and 120 are typically positioned directly above the conductive runners of the printed circuit board. A solder paste is positioned between each conductive electrode surface and the respective conductive runner of the printed circuit. The entire assembly is then heated, causing the solder to melt and producing an electrical contact between the electrodes 118 and 120 and the conductive runners of the printed circuit board.

When utilizing the varistor 110 in such applications, it is essential that the varistor be properly oriented with respect to the printed circuit board. That is, the varistor must be positioned so that the second major surface 116, on which a portion of both the first and second electrodes 118 and 120 are disposed, faces the printed circuit board. If, instead, the varistor 110 were to be oriented so that the first major surface 114 faced the printed circuit board, electrical contact would not be made between the conductive runners of the printed circuit and the electrode 120. Since, in this orientation, no electrical contact would be made with the second electrode 120, the final assembled circuit would not function as intended. The necessity of properly orienting the second major surface 116 with respect to the printed circuit board, and then verifying the proper orientation of the varistor 110 prior to soldering, adds considerable time and expense to the assembly process.

Figure 3:
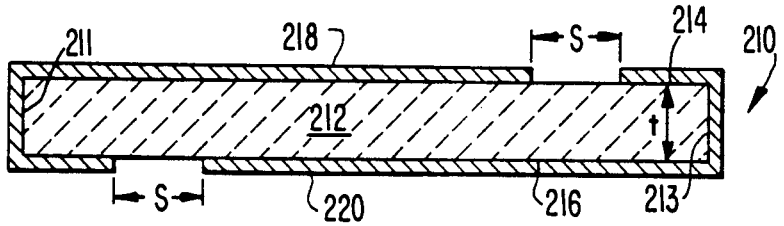
FIG. 3 is a side-sectional view of a varistor in accordance with one embodiment of the present invention in which two electrodes are mounted symmetrically on the varistor body.

FIG. 3 illustrates a varistor 210 in accordance with one embodiment of the present invention. A varistor body 212 has first and second electrodes 218 and 220 attached respectively to the first major surface 214 and the second major surface 216 of the varistor body 212. The formation of the body 212 as well as the attachment of the electrodes 218 and 220 thereto may be as hereinabove described in conjunction with FIG. 1.

In the varistor 210 a portion of the first electrode 218 associated with the first major surface 214 is extended along a first end 211 of the varistor body 212 and further extended along a portion of the second major surface 216. Thus, both the second electrode 220 and a portion of the first electrode 218 are positioned on the second major surface 216 of the varistor body 212.

In a similar manner, the second electrode 220 associated with the second major surface 216 is extended along a second, opposite end 213 of the varistor body 212 and further extended along a portion of the first major surface 214. Thus, both the first electrode 218 and a portion of the second electrode 220 are positioned on the first major surface 214 of the varistor body 212.

The portion of the first electrode 218 positioned on the second major surface 220 is substantially similar in size and shape to that portion of the second electrode 220 which is positioned on the first major surface 218. The proximal spacing S between the electrodes 218 and 220 on the first major surface 214 is substantially equal to the proximal spacing S between the electrodes 218 and 220 on the second major surface 216. Again, the distance S is preferably greater than the thickness t of the varistor body 212, for reasons similar to those discussed above with respect to varistor 110. The first and second electrodes 218 and 220 are thereby substantially counter-symmetrically disposed about the first and second major surfaces 214 and 216 of the varistor body 212, as illustrated in FIG. 3. (As used herein, the term "counter-symmetric" defines an arrangement in which the first electrode forms a mirror image of the second electrode, rotated by one-hundred-eighty degrees about an axis which runs perpendicular to the planes defined by the first and second major surfaces.)

The counter-symmetrical arrangement of the electrodes 218 and 220 provides particular advantages in several surface mount applications. As previously discussed, surface-mount varistors are preferably designed to be deposited in position on, for example, a printed circuit board. With nonsymmetric surface-mount varistors, such as varistor 110 illustrated in FIG. 2, it is necessary to properly orient the first and second major surfaces of the varistor prior to placement on the printed circuit board.

The need to verify the orientation of the major surfaces of a varistor prior to soldering is eliminated by the counter-symmetric arrangement of the electrodes 218 and 220 of the varistor 210 illustrated in FIG. 3. That is, regardless of whether the first or second major surface 214 and 216 of the varistor body 212 faces the runners of the printed circuit board, both the first and second electrodes 218 and 220 are always presented for electrical contact to the surface of the board. Since the orientation of the first and second major surfaces 214 and 216 of the varistor 210 does not need to be verified prior to placement of the varistor on the printed circuit board, assembly time may be significantly decreased.

Figure 4:
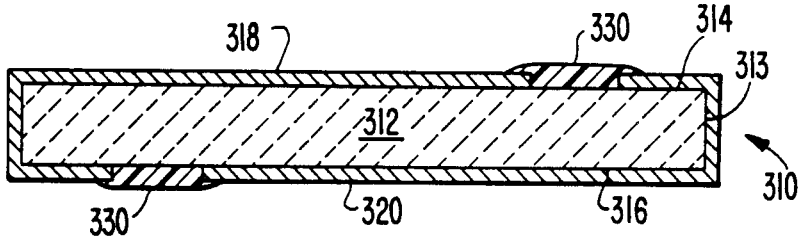
FIG. 4 is a side-sectional view of a varistor in accordance with another embodiment of the present invention in which dielectric material is disposed between electrodes.

FIG. 4 illustrates a varistor 310 having electrodes 318 and 320 substantially counter-symmetrically disposed about the major surfaces 314 and 316 of the varistor body 312 in a manner similar to that of varistor 210 of FIG. 3. In the varistor device 310 of FIG. 4, however, the areas between the electrodes 318 and 320 on the surfaces 314 and 316 of the varistor body 312 are filled by an insulating or passivating dielectric material 330. This insulating material may, for example, be in the form of a glass or polymer. A passivating coating, such as that described in U.S. Pat. No. 3,857,174, may also be utilized for this purpose. The insulating or passivating material 330 prevents stray currents from interfering with the operation of the varistor 310 and further allows the varistor 310 to be utilized in a relatively "dirty" atmosphere. That is, the presence of the insulating or passivating material 330 allows the varistor 310 to be soldered without mobile ions interfering with the active surfaces 314 and 316 of the varistor body 312 between the electrodes 318 and 320. The passivating or insulating material 330 thereby serves to improve device stability and reduce leakage current, thus providing substantially improved device performance.

Figure 5:
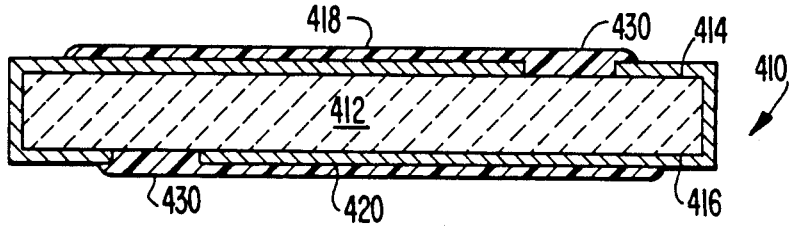
FIG. 5 is a side-sectional view of a varistor in accordance with another embodiment of the present invention in which dielectric material is disposed atop a portion of the electrode surfaces.

FIG. 5 illustrates a varistor device 410 having electrodes 418 and 420 disposed substantially counter-symmetrically about the major surfaces 414 and 416 of the varistor body 412 in a manner similar to that of varistor 210 illustrated in FIG. 3. The areas between the electrodes 418 and 420 on the major surfaces 414 and 416 of the varistor body 412 are filled by an insulating or passivating dielectric material 430 in a manner similar to that of varistor 310 illustrated in FIG. 4. However, in the varistor device 410 of FIG. 5, the dielectric material 430 which fills the space between the electrodes 418 and 420 on the first major surface 414 is extended over a portion of the surface of the electrode 418 which is positioned on the first major surface 414. A relatively small surface region of the electrode 418 is not covered by the dielectric 430, in order to facilitate electrical contact between the electrode 418 and, for example, the conductive runner of a printed circuit board.

The dielectric material 430 which fills the space between electrodes 418 and 420 on the second major surface 416 is similarly extended over a portion of the surface of the electrode 420 positioned on the second major surface 416. A relatively small surface region of the electrode 420 is not covered by the dielectric 430, again to facilitate electrical contact between the electrode 420 and, for example, the conductive runner of a printed circuit board. The extension of the dielectric material 430 to cover portions of the surfaces of first and second electrodes 418 and 420 is useful in preventing the spread of solder along the electrodes 418 and 420 during the soldering process.

Figure 6:
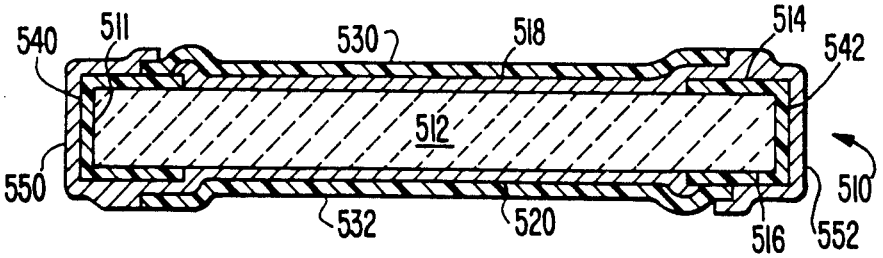
FIG. 6 is a side-sectional view of a varistor in accordance with an alternative embodiment of the present invention in which a symmetric, passivating coating is provided.

FIG. 6 illustrates a varistor 510 in accordance with another embodiment of the present invention. A varistor body 512 is provided with first and second electrodes 518 and 520 which are attached respectively to the first major surface 514 and second major surface 516 of the varistor body 512.

A first layer of dielectric material 540 is provided on a first end 511 of the varistor body 512. A portion of the dielectric material 540 covers a region of the first major surface 514 adjacent the first end 511 of the varistor body 512. Another portion of the dielectric material 540 covers a region of the second major surface 516 adjacent the first end 511 of the varistor body 512.

A second layer of dielectric material 542 is provided on a second, opposite end 513 of the varistor body 512. A portion of the dielectric material 542 covers a region of the first major surface 518 adjacent the second end 513 of the varistor body 512. Another portion of the dielectric material 542 covers a region of the second major surface 520 adjacent the second end 513. Those portions of the first and second dielectric layers 540 and 542 which cover regions of the first and second major surfaces 518 and 520 are, in the preferred embodiment, substantially similar in size and shape. The dielectric layers 540 and 542 are preferably composed of a material, such as glass, which is capable of withstanding the high temperatures required for the subsequent application of the metalization layers 550 and 552, as discussed in greater detail hereinbelow.

The first electrode 518, which is positioned on the first major surface 514 of the varistor body 512, extends along the first major surface 514 from an area immediately adjacent the edge of the first dielectric layer 540 to an area immediately adjacent the edge of the second dielectric layer 542. Preferably, a portion of the first electrode 518 overlaps the edge of the first dielectric layer 540 and another portion of the first electrode 518 overlaps the edge of the second dielectric layer 542, as illustrated in FIG. 6.

The second electrode 520, which is positioned on the second major surface 516 of the varistor body 512, extends along the second major surface 516 from an area immediately adjacent the edge of the first dielectric layer 540 to an area immediately adjacent the edge of the second dielectric layer 542. Preferably, a portion of the second electrode 520 overlaps the edge of the first dielectric layer 540 and another portion of the second electrode 520 overlaps the edge of the second dielectric layer 542. Thus, when viewed from a side sectional perspective as in FIG. 6, the surface of the varistor body 512 is covered either by one of the first or second electrodes 518 and 520 or by one of the first or second dielectric layers 540 and 542.

A third dielectric layer 530 is positioned atop a substantial portion of the surface of the first electrode 518.

However, a small region of the surface of the first electrode 518 adjacent the second end 513 of the varistor body 512 is not covered by the third dielectric layer 530. The exposed surface region of the first electrode 518 facilitates electrical contact with the metalization layer 552, as discussed in greater detail hereinbelow. The region of the third dielectric layer 530 adjacent the first end 511 of the varistor body 512 contacts the first dielectric layer 540. Thus, the entire edge of the first electrode 518 adjacent the first end 511 of the varistor body 512 is fully insulated by the first and third dielectric layers 540 and 530. substantial portion of the surface of the second electrode 520. However, a small region of the surface of the second electrode 520 adjacent the first end 511 of the varistor body 512 is not covered by the fourth dielectric layer 532. The exposed surface region of the second electrode 520 is provided to enable electrical contact between the second electrode 520 and the metalization layer 550. The region of the fourth dielectric layer 532 adjacent the second end 513 of the varistor body 512 contacts the second dielectric layer 542. Thus, the entire edge of the second electrode 520 adjacent the second end 513 of the varistor body 512 is fully insulated by the second and fourth dielectric layers 542 and 532.

A first metalization layer 550 is provided atop the first dielectric layer 540. The first metalization layer 550 is extended to abut the edge of the fourth dielectric layer 532 and to be in electrical contact with the second electrode 520. The first metalization layer 550 thereby presents an electrical contact surface adjacent the second major surface 516, through which electrical contact may be made between the second electrode 520 and, for example, the runners of a printed circuit board.

The first metalization layer 550 is further extended to abut the edge of the third dielectric layer 530 and, in the preferred embodiment, a portion of the first metalization layer 550 overlaps the edge of the third dielectric layer 530. The first metalization layer 550 thereby presents an electrical contact surface adjacent the first major surface 514, through which electrical contact may be made between the second electrode 520 and, for example, the runners of a printed circuit board.

A second metalization layer 552 is provided atop the second

A second metalization layer 552 is provided atop the second dielectric layer 542. The second metalization layer 552 is extended to abut the edge of the third dielectric layer 530 and to be in electrical contact with the first electrode 518. The second metalization layer 552 thereby presents an electrical contact surface adjacent the first major surface 514, through which electrical contact may be made between the first electrode 518 and the runner of a printed circuit board.

The second metalization layer 552 is further extended to abut the edge of the fourth dielectric layer 532 and, in the preferred embodiment, a portion of the second metalization layer 552 overlaps the edge of the fourth dielectric layer 532. The second metalization layer 552 thereby presents an electrical contact surface adjacent the second major surface 516 through which electrical contact may be made between the first electrode 518 and the runners of a printed circuit board.

The varistor device 510 is thus fully counter-symmetric with respect to the first and second major surfaces 514 and 516. That is, terminals are provided adjacent both major surfaces for electrical connection to both electrodes 518 and 520. The varistor 510 thereby provides the same advantages in surface mount applications as discussed above with respect to the counter-symmetric varistor 210, for example.

Moreover, the various dielectric layers 530, 532, 540 and 542 provide full passivation of the varistor device 510. The varistor 510 is thereby protected from the environment and requires no additional encapsulation.

Figure 7:
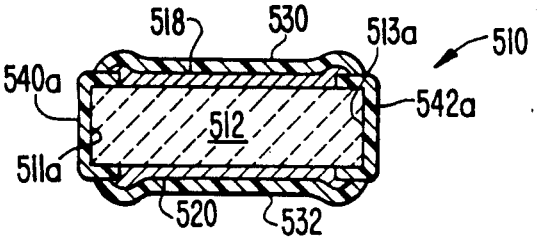
FIG. 7 is an end-sectional view of the device of FIG. 6.

FIG. 7 is an end-sectional view of the varistor 510 illustrated in FIG. 6. As shown in FIG. 7, first and second dielectric layers **540*a* and 542*a* are disposed on the first and second sides 511*a* and 513*a* of the varistor body 512, in a manner similar to the disposition of dielectric layers 540 and 542 with respect to the first and second ends 511 and 513 of the varistor body 512. The dielectric layers 540*a* and 542*a* may be composed of glass or other material similar in composition to that used for the dielectric layers 540 and 542. However, because no metalization is intended to be placed upon the dielectric layers 540*a* and 542*a*, it is not necessary that the material be capable of withstanding the high temperatures required for the application of a metalization layer. Thus, the dielectric material of layers 540*a* and 542*a*** may consist of a plastic polymer or the like.

FIG. 7 illustrates first and second electrodes 518 and 520 positioned respectively on the first and second major surfaces 514 and 516 of the varistor body 512. The edges of the first and second electrodes 518 and 520 abut the edges of the dielectric layers **540*a* and 542*a*. A small portion of the first and second electrodes 518 and 520 may overlap the dielectric layers 540*a* and 542*a*, as shown in FIG. 7**.

Third and fourth dielectric layers 530 and 532 are positioned atop the electrodes 518 and 520. The third and fourth dielectric layers 530 and 532 extend over the entire surfaces of the electrodes 518 and 520, respectively, so that the edges of the third and fourth dielectric layers 530 and 532 contact the dielectric layers **540*a* and 542*a*. The electrodes 518 and 520, when viewed from an end sectional perspective as in FIG. 7**, are thereby fully insulated from the environment and require no additional encapsulation.

It will therefore be recognized that the present invention may be embodied in a variety of specific forms. The foregoing disclosed embodiments are therefore to be considered in all respects as illustrative and not restrictive. The scope of the invention being indicated by the appended claims, rather than the foregoing description, and all variations which come within the meaning and range of equivalency of the claims are intended to be embraced therein.

What is claimed is:

1. A varistor comprising:

a varistor body having a first major surface and an opposed second major surface;

a first electrode disposed on at least a portion of said first major surface and on at least a portion of said second major surface;

a second electrode disposed on at least a portion of said first major surface and on at least a portion of said second major surface;

said first and second electrodes being counter-symmetrically disposed on said varistor body about an axis lying midway between and parallel to said first and second major surfaces, wherein the proximal distance between said portions of said first and said second electrodes disposed on the same major surface of said varistor body is greater than the distance between said first and second major surfaces.

2. A varistor as in claim 1 wherein the proximal distance between said portions of said first and second electrodes disposed on the same major surface of said varistor body is greater than the distance between said first and second major surfaces.

3. A varistor as in claim 1 further comprising:

a first dielectric layer disposed on said first major surface between said first electrodes and said second electrode; and a second dielectric layer disposed on said second major surface between said first electrode and said second electrode.

4. A varistor comprising:

a varistor body having a first major surface and an opposed second major surface;

a first electrode disposed on at least a portion of said first major surface and on at least a portion of said second major surface;

a second electrode disposed on at least a portion of said first major surface and on at least a portion of said second major surface;

said first and second electrodes being counter-symmetrically disposed on said varistor body about an axis lying midway between and parallel to said first and second major surfaces;

said first and second electrodes being separated by a distance which is at least as great as the distance separating said first major surface and said second major surface.

5. A varistor as in claim 3 wherein said first dielectric layer covers a portion of said first electrode and said second dielectric layer covers a portion of said second electrode.

6. A varistor comprising:

a varistor body having a first major surface and on opposed second major surface;

a first electrode disposed on said first major surface;

a second electrode disposed on said second major surface; said first and second electrodes being counter-symmetrically disposed on said varistor body about an axis line midway between and parallel to said first and second major surfaces wherein the proximal distance between said portions of said first and second electrodes disposed on the same major surface of said varistor body is greater than the distance between said first and second major surfaces;

a first input terminal and a second input terminal associated respectively with said first major surface and said second major surface;

a first output terminal and a second output terminal associated respectively with said first major surface and said second major surface;

each of said output terminals being in electrical contact with said first electrode;

each of said input terminals being in electrical contact with said second electrode.

7. A device as in claim 6 further comprising:

a first dielectric layer disposed between said varistor body and said output terminals; and a second dielectric layer disposed between said varistor body and said input terminals.

8. A varistor as in claim 7 wherein said first dielectric layer covers at least a portion of said second electrode and said second dielectric layer covers at least a portion of said first electrode.

9. A varistor comprising:

a varistor body having a first major surface and an opposed second major surface;

a first electrode disposed on said first major surface;

a second electrode disposed on said second major surface; said first and second electrodes being counter-symmetrically disposed on said varistor body about an axis line midway between and parallel to said first and second major surfaces wherein the proximal distance between said portions of said first and second electrodes disposed on the same major surface of said varistor body is greater than the distance between said first and second major surfaces;

a first input terminal and a second input terminal associated respectively with said first major surface and said second major surface;

a first output terminal and a second output terminal associated respectively with said first major surface and said second major surface;

means for establishing electrical contact between said first output terminal and said first electrode;

means for establishing electrical contact between said second output terminal and said first electrode;

means for establishing electrical contact between said first input terminal and said second electrode;

means for establishing electrical contact between said second input terminal and said second electrode.

10. A device as in claim 9 further comprising:

a first dielectric layer disposed between said varistor body and said output terminals; and a second dielectric layer disposed between said varistor body and said input terminals.

11. A device as in claim 10 wherein said first dielectric layer is disposed between said varistor body and said means for establishing electrical contact between said second output terminal and said first electrode, and said second dielectric layer is disposed between said varistor body and said means for establishing electrical contact between said first input terminal and said second electrode.

* * * * *

UNITED STATES PATENT AND TRADEMARK OFFICE
CERTIFICATE OF CORRECTION

PATENT NO. : 4,706,060

DATED : Nov. 10, 1987

INVENTOR(S) : John E. Mav

It is certified that error appears in the above-identified patent and that said Letters Patent is hereby corrected as shown below:

Column 7 Line 12 after "530. " insert --A fourth dielectric layer 532 is positioned atop a--

Column 7 Lines 44-45 delete --A second metalization layer 552 is provided atop the second--

Signed and Sealed this

Thirteenth Day of September, 1988

*Attest:*

DONALD J. QUIGG

*Attesting Officer*

*Commissioner of Patents and Trademarks*